US006183625B1

(12) United States Patent
Staerzl

(10) Patent No.: US 6,183,625 B1
(45) Date of Patent: Feb. 6, 2001

(54) MARINE GALVANIC PROTECTION MONITOR

(75) Inventor: Richard E. Staerzl, Fond du Lac, WI (US)

(73) Assignee: Brunswick Corporation, Lake Forest, IL (US)

( * ) Notice: Under 35 U.S.C. 154(b), the term of this patent shall be extended for 0 days.

(21) Appl. No.: 09/435,149

(22) Filed: Nov. 8, 1999

(51) Int. Cl.[7] ..... C23F 13/00

(52) U.S. Cl. ..... 205/727; 205/724; 205/730; 205/740; 204/196.01; 204/196.06; 204/196.11; 204/196.21; 204/196.26; 204/196.36; 204/196.37

(58) Field of Search ..... 204/196.01, 196.06, 204/196.11, 196.21, 196.26, 196.36, 196.37; 205/724, 727, 740

(56) References Cited

U.S. PATENT DOCUMENTS

| | | | | |
|---|---|---|---|---|
| 3,953,742 | | 4/1976 | Anderson et al. | 307/95 |
| 4,117,345 | | 9/1978 | Balcom | 307/95 |
| 4,528,460 | | 7/1985 | Staerzl | 307/95 |
| 4,664,764 | * | 5/1987 | Zofan | 204/196.01 |
| 4,713,158 | * | 12/1987 | Lambert | 204/196.01 |
| 5,627,414 | | 5/1997 | Brown et al. | 307/95 |
| 5,747,892 | | 5/1998 | Staerzl | 307/95 |
| 5,840,164 | | 11/1998 | Staerzl | 204/196 |

OTHER PUBLICATIONS

"Everything you need to know about marine corrosion" published by the Quicksilver Marine Parts and Accessories Division of Mercury Marine, division of Brunswick Corporation (1996).

* cited by examiner

*Primary Examiner*—Bruce F. Bell
(74) *Attorney, Agent, or Firm*—William D. Lanyi

(57) ABSTRACT

A galvanic monitor system uses two annunciators, such like light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciators lights are used to inform the operator if the protection is proper or if the component to be protected is either being over protected or under protected.

15 Claims, 4 Drawing Sheets

MARINE GALVANIC PROTECTION MONITOR

BACKGROUND OF THE INVENTION

1. Field of the Invention

The present invention is generally related to a system for monitoring a galvanic protection system and, more particularly, to a monitor system which provides an easily recognizable signal representing the current state of a galvanic protection system without the need for operator.

2. Description of the Prior Art

It is widely known to those skilled in the art that certain submerged components can experience galvanic corrosion when used in conjunction with a marine vessel, such as a boat. Various types of corrosion prevention systems are available to prevent galvanic corrosion of marine propulsion system components. These include sacrificial anodes and electrical systems that inhibit galvanic corrosion of marine components. When connected properly and operated in conformance with suggested procedures, these known prevention systems work adequately. However, if the galvanic corrosion system is not working properly, a boat operator generally will not be aware of this condition without some active involvement by the boat operator. As an example, a sacrificial anode may be missing or so severely depleted that it is ineffective. In addition, an electrical prevention system can experience a broken wire or a connection that is inadvertently loosened. Although one system is available in the prior art that permits an operator to actively cause a circuit to be completed to check certain characteristics of one particular type of electrical corrosion prevention system, no passive monitor is currently available that automatically informs a boat operator of a problem in a galvanic protection system without requiring the operator to first request the monitor to check the system.

U.S. Pat. No. 4,117,345, which issued to Balcom on Sep. 26, 1978, describes a marine ground isolator. The isolator selectively completes the current path through a ground connection. The preferred of the isolator includes a switch circuit connected in series between two portions of the ground connection and arranged so as to complete the current path therethrough only in response to an applied control signal. It further comprises means for monitoring the potential between the two portions of the ground connection and for applying the control signal to the switch circuit only when the absolute magnitude of the dc potential exceeds a first value or when the ac potential exceeds a second value.

U.S. Pat. No. 5,627,414 which issued to Brown et al on May 6, 1997, describes an automatic cathodic protection system using galvanic anodes. The automatic system uses sacrificial galvanic anodes to provide a controlled and optimum amount of cathodic protection against galvanic corrosion on submerged metal parts. Intermittently pulsed control circuitry enables an electro-mechanical servo system to control a resistive element interposed between the sacrificial anodes and the electrically bonded underwater parts. In an active mode of operation, a current is applied directly to the anodes to quickly establish the proper level of correction which is maintained during the passive mode. Incremental corrections are made over a period of time to provide stabilization of the protection and to conserve power. A visual indication of the amount of protection is available at all times. Circuitry and indicating devices are included which facilitate location and correction of potentially harmful stray currents and to prevent loss of sacrificial anodes to nearby marine structures.

U.S. Pat. No. 5,840,164, which issued to Staerzl on Nov. 24, 1998, discloses a galvanic isolator used to protect against galvanic corrosion of a submersible metal marine drive. The galvanic isolator is positioned between shore ground and boat ground to prevent the flow of destructive galvanic currents between the shore ground and the boat ground, while maintaining the safety function of neutral ground. The galvanic isolator of the invention includes a blocking element positioned between the boat ground and the shore ground that can be switched between an open and a closed state by a trigger circuit. The trigger circuit closes the blocking element when the difference between the boat ground and the shore ground exceeds a threshold value, such as 1.4 volts. During operation of the galvanic isolator during the high fault current condition, power is dissipated only by the blocking element, rather than by the combination of the blocking element and the trigger device. In this manner, the galvanic isolator reduces the amount of power dissipated during high current conditions and therefore reduces the amount of heat generated by the galvanic isolator.

U.S. Pat. No. 5,747,892, which issued to Staerzl on May 5, 1998, discloses a galvanic isolator fault monitor. The system and method for testing and monitoring the operation of a galvanic isolator are provided by this device. The isolator is positioned between shore ground and boat ground to prevent the flow of destructive galvanic currents between the shore ground and the boat ground. The monitoring system transmits a test current through the galvanic isolator at specific time intervals to test the effectiveness of the galvanic isolator. The monitoring system includes a first counter that outputs an enabling signal after a period of time. The enabling signal allows a test current to flow through the galvanic isolator for a brief period of time determined by a second counter. As the test current flows through the galvanic isolator, a current sensing circuit measures the test current and activates an alarm if the test current flowing through the galvanic isolator falls outside a predetermined range. In this manner, the monitoring system of the invention monitors and periodically tests a galvanic isolator.

U.S. Pat. No. 4,528,460, which issued to Staerzl on Jul. 9, 1985, describes a cathodic protection controller. The control system for cathodically protecting an outboard drive unit from corrosion includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 3,953,742, which issued to Anderson et al on Apr. 27, 1976, discloses a cathodic protection monitoring apparatus for marine propulsion device. The monitor is coupled to an impressed current cathodic protection circuit used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode lamp or other light source between the controller output and ground so that the controller current may, when tested, be used to operate the light source in order to confirm that power is available to the anode.

The United States patents described above are hereby explicitly incorporated by reference in the description of the present invention.

A booklet titled "Everything you need to know about marine corrosion" and published by the Quicksilver Marine Parts and Accessories Division of Mercury Marine, which is a division of the Brunswick Corporation, provides a detailed description on the electrochemistry of marine corrosion and also describes numerous techniques and devices available for the prevention of marine corrosion.

Notwithstanding the existence of many different systems for the prevention of galvanic corrosion of marine components, it would be significantly beneficial if a monitoring system could be provided that did not require active participation by a boat operator but provided a visual signal of the present operating condition of the galvanic corrosion prevention system.

SUMMARY OF THE INVENTION

A preferred embodiment of the present invention provides a marine galvanic protection monitor that comprises an electrode disposed in noncontact association with a component to be protected from corrosion. It also comprises a first comparator connected in signal communication with the electrode and with a first reference signal, the first comparator providing a first output signal which is representative of the relative magnitudes of the voltage potentials of the electrode and the first reference signal. The monitor further comprises a second comparator connected in signal communication with the electrode and with a second reference signal to provide a second output signal which is representative of the relative magnitudes of the voltage potentials of the electrode and the second reference signal. The first and second comparators are connected in signal communication with the component to be protected from corrosion.

A particularly preferred application of the present invention is in conjunction with a marine propulsion unit that serves as the component to be protected from corrosion. The marine propulsion system can be a stern drive unit or an outboard motor.

In one particularly preferred embodiment of the present invention, the first output signal and the second output signal are both high when the voltage potential of the electrode is higher than the first reference signal. Furthermore, the second output signal is high when the voltage potential of the electrode is higher than the second reference signal. The first output signal is high when the voltage potential of the electrode is lower than the second reference signal.

A battery can be connected in electrical communication with the electrode, with the first comparator, and with the second comparator. The electrode can be attached to a transom of a boat to which the component to be protected from corrosion is also attached.

In a preferred embodiment of the present invention, a first annunciator is connected in electrical communication with the first output signal and a second annunciator is connected in electrical communication with the second output signal. The annunciators can be light emitted diodes (LED's). Certain types of LED's can provide two different color outputs in a single component. If the two outputs are red and green, for use as the first and second annunciators, a combined first and second output can be yellow to indicate the presence of both the first and second output signals in a high state.

In order to conserve electrical energy, an oscillator can be connected in electrical communication with the first and second annunciators to periodically deactivate the first and second annunciators independently of the state of the first and second output signals.

The present invention provides the method for monitoring a marine galvanic protection system that comprises the steps of providing an electrode disposed in non-contact association with the component to be protected from corrosion, comparing a voltage potential of the electrode with a first reference signal, provided a first output signal which is representative of the relative magnitudes of the voltage potentials of the electrode and the first reference signal, comparing a voltage potential of the electrode with a second reference signal, and providing a second output signal which is representative of the relative magnitudes of the voltage potentials of the electrode and the second reference signal.

BRIEF DESCRIPTION OF THE DRAWINGS

The present invention will be more fully and completely understood from a reading of the description of the preferred embodiment in conjunction with the figures, in which.

DESCRIPTION OF THE PREFERRED EMBODIMENT

Figure 1:
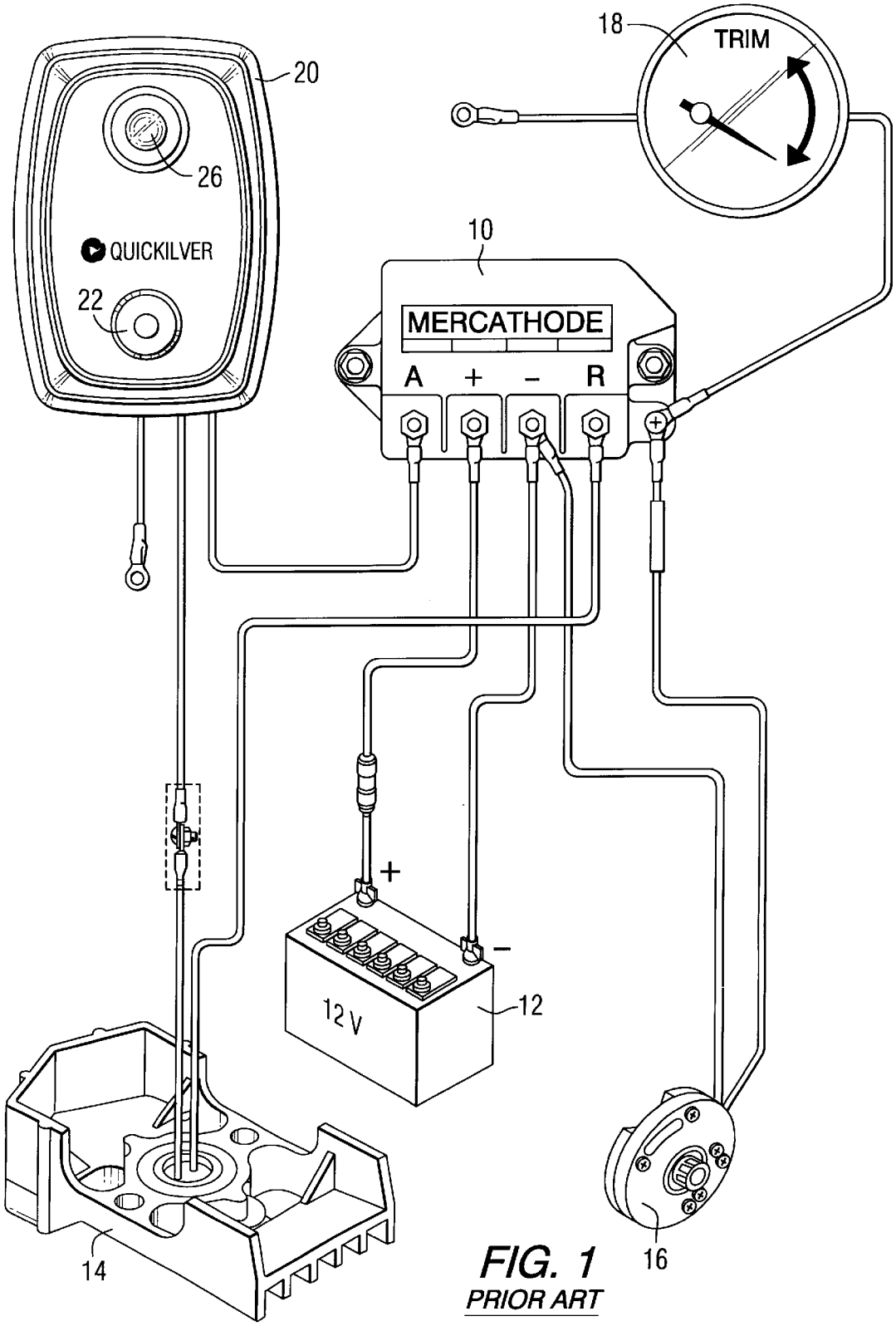
FIG. 1 PRIOR ART
FIG. 1 shows a corrosion prevention system known to those skilled in the art.

Throughout the description of the preferred embodiment, like components will be identified by like reference numerals.

FIG. 1 shows a known type of galvanic protection system that is available in commercial quantities from the Quicksilver division of Mercury Marine which, in turn, is a division of the Brunswick Corporation. It shows a controller 10 that is connected in electrical communication with a power source, such as a battery 12, which provides DC power to an electrode 14. Although not directly related to the galvanic protection system, FIG. 1 also shows a trim position sender 16 connected in electrical communication with the battery 12 and with a trim gauge 18. A currently available monitor 20 can be connected to the controller 10 in order to allow an operator to press a button 22 to see if power is available to the electrode 14 from the battery 12. If the connection is made properly and power is available from the battery 12, an annunciator light 26 is energized. The monitor 20 does not actually determine the voltage potential in the water surrounding a component to be protected from galvanic corrosion. Instead, the monitor 20 informs the operator that the battery 12 is connected properly to the anode 14. In addition, the monitor 20 requires that the operator actively press the button 22 in order to activate the annunciator light 26.

Figure 2:
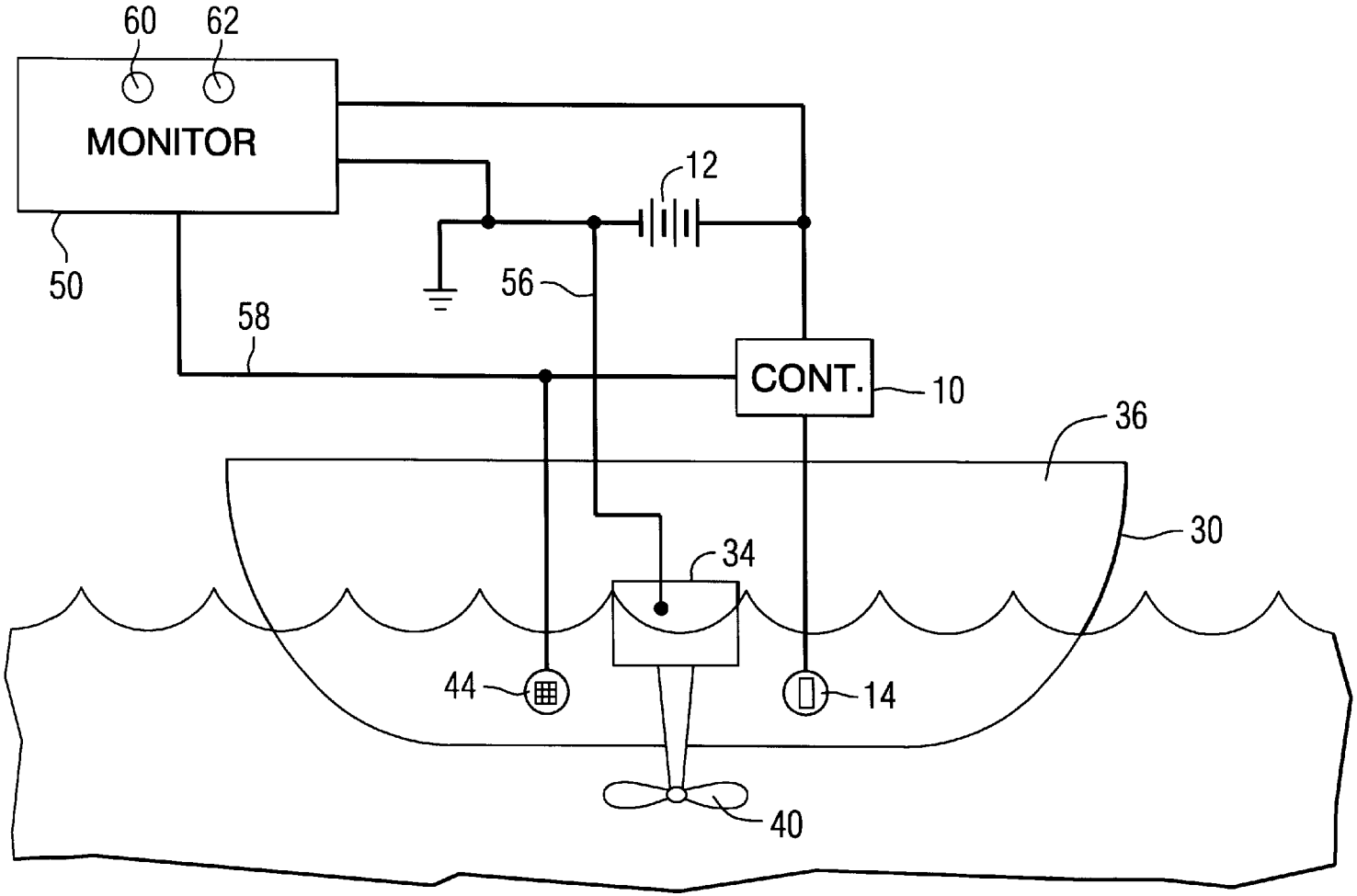
FIG. 2 shows one application of the present invention with a certain type of corrosion prevention system.

FIG. 2 is a highly schematic representative of the rear portion of a boat 30 with a stern drive unit 34 attached to the transom 36 of the boat 30. A propeller 40 is attached to a propeller shaft of the stern drive unit 34 to propel the boat 30. A controller 10, which is generally similar to that described above in conjunction with FIG. 1, is electrically connected to an anode 14 that is located under the surface of the water and attached to the transom 36 of the boat 30. The controller 10 is connected to the battery 12 and to a reference electrode 44. Although the type of controller 10 is not limiting to the present invention, some controllers 10 are available which are capable of measuring the voltage field in the water proximate the reference electrode 44 and using that signal to control the magnitude of the signal provided at the anode 14. A system for preventing galvanic corrosion of marine components is available from the Quicksilver division of the Mercury Marine division of the Brunswick Corporation. This system is referred to as the MerCathode system and it provides an automatic, permanent protection against galvanic corrosion. A solid state device, such as the controller 10, operates with power provided by a 12 volt battery 12. The galvanic protection system provides protection by impressing a reverse blocking current that stops the destructive flow of galvanic currents through the water in the vicinity of the stem drive unit 34.

Galvanic corrosion occurs when two dissimilar metals are grounded, or connected electrically to each other and immersed in an electrolyte, such as sea water. Electrons flow from the more chemically active metal, such as aluminum, to the less chemically active metal, such as stainless steel, through the external connection or ground. Positively charged ions move from the anode and negatively charged ions move from the cathode through the electrolyte, such as sea water. The result of this process is the dissolving of the anode, or aluminum stern drive housing component. By providing an opposing current through the conductive liquid, the MerCathode system essentially blocks the ions from leaving the more chemically active material, which is generally the aluminum metal of the stern drive 34 housing. The MerCathode consists of a controller 10, a reference electrode 44, and an anode 14, or electrode. The reference electrode 44 senses the corrosion potential of the drive in the water and regulates the controller 10 to keep the protective current within a prescribed range for optimum blocking and, hence, optimal corrosion protection. The protective current from the battery 12 is emitted into the water via the controller 10 and the anode 14. The surface of the anode 14 is generally platinum coated so that it will not corrode due to the current flow, like sacrificial anodes would under these same circumstances. The MerCathode system automatically adjusts itself to compensate for changes in corrosion potential caused by variations in water temperature, velocity, and conductivity. It also compensates for changes in the condition of the paint on the drive unit 34.

Although galvanic protection systems, such as the MerCathode protection system, work effectively in most circumstances, it is always possible that a portion of the system may become damaged. For example, the anode 14 can be damaged or inadvertently disconnected from the circuit. Similarly, the battery 12 may become drained or disconnected from the circuit. Any of these circumstances can cause the galvanic protection normally provided by the system to be disabled.

The present invention provides a monitor 50 which is connected to the electrode 44 which, as described above, is disposed in non-contact association with a component, such as the stern drive unit 34, to be protected from corrosion. The monitor 50 is also connected in electrical communication with the battery 12 and with the component to be protected from corrosion. Line 56 is the connection between the monitor 50 and the component to be protected from corrosion. Line 58 is the connection between the monitor 50 and the electrode 44.

Also shown in FIG. 2 are two annunciators. A first annunciator 60 informs the boat operator if the galvanic protection current provided by the anode 14, or any other protection source is within a preselected range that has been determined to be effective. More specifically, the first annunciator 60, when activated, represents a state in which the voltage sensed by the electrode 44 is either too high or too low. A second annunciator 62 is activated by the monitor 50 when the voltage sensed by the electrode 44 is sufficiently high (i.e. not too low) to provide protection to the stern drive unit 34. However, in a preferred embodiment of the present invention, the second annunciator 62 is also activated when the voltage sensed by the electrode 44 is actually too high for the intended purposes of the system.

Although FIG. 2 shows the present invention used in association with the controller 10 and anode 14 of a galvanic protection system, such as a MerCathode, it should be understood that the monitor does not require the use of this type of galvanic protection system.

Figure 3:
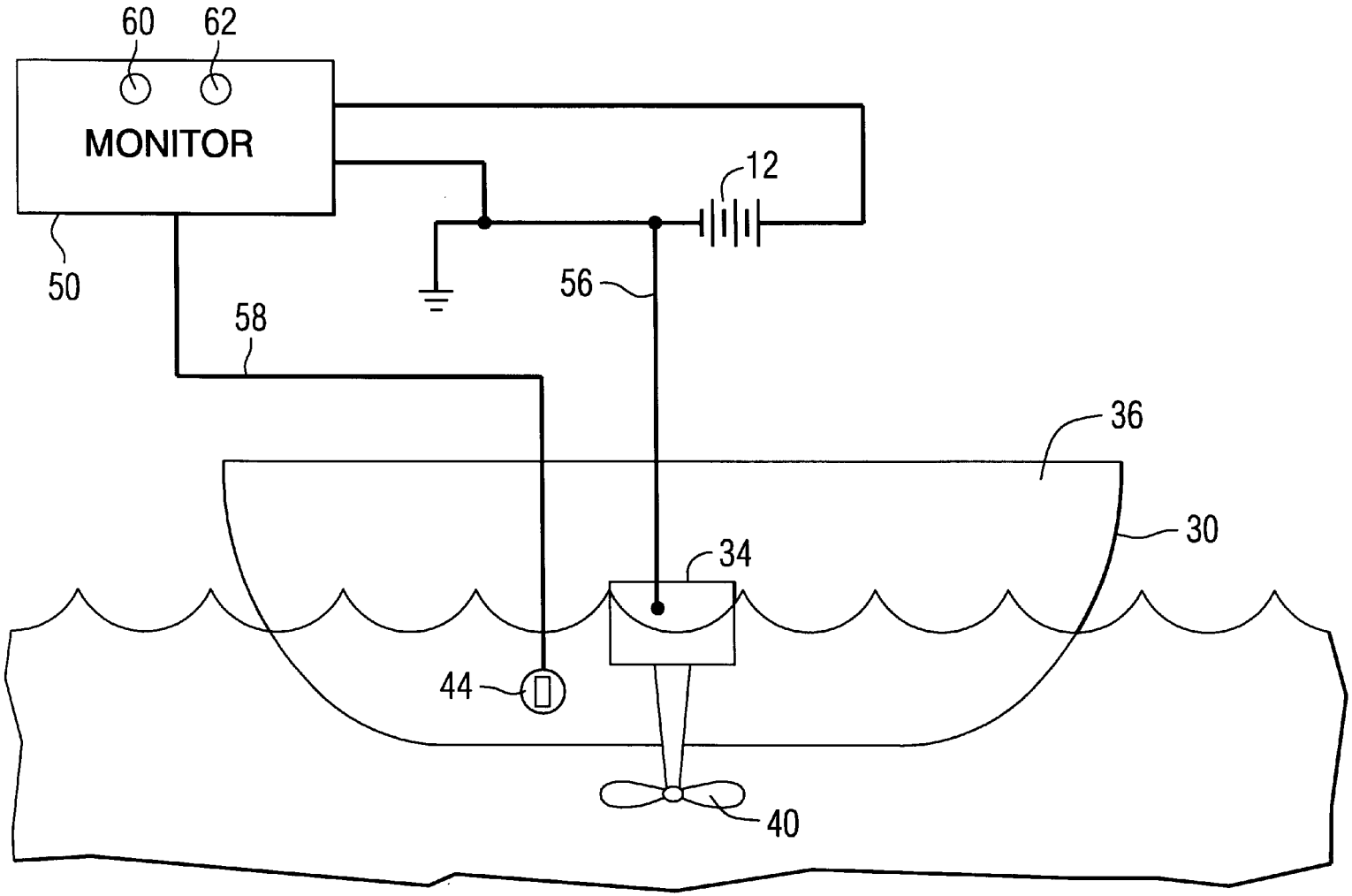
FIG. 3 shows an alternative application of the present invention in conjunction with a system using only a sacrificial anode.

FIG. 3 illustrates the present invention used in association with a marine propulsion system that is not equipped with a galvanic protection system, such as the MerCathode, but is instead protected solely by a sacrificial anode (not shown in FIG. 3). The monitor 50 is shown connected to the battery 12 and also to the grounded component to be protected from corrosion which, in this case, is a stern drive unit 34. The monitor 50 is also connected to the reference electrode 44 by line 58. The two annunciators, 60 and 62, are provided to signal the boat operator and inform the operator of the operating status of the galvanic protection system, which in this case comprises only a sacrificial anode.

With reference to FIGS. 2 and 3, it can be seen that the monitor 50 remains connected to both the stern drive unit 34 and the reference electrode 44 regardless of whether the galvanic protection system of the controller 10 and anode 14 is used. Therefore, it should be understood that the present invention is able to monitor the current galvanic protection status of a component to be protected from corrosion regardless of the type of protection system being used.

Figure 4:
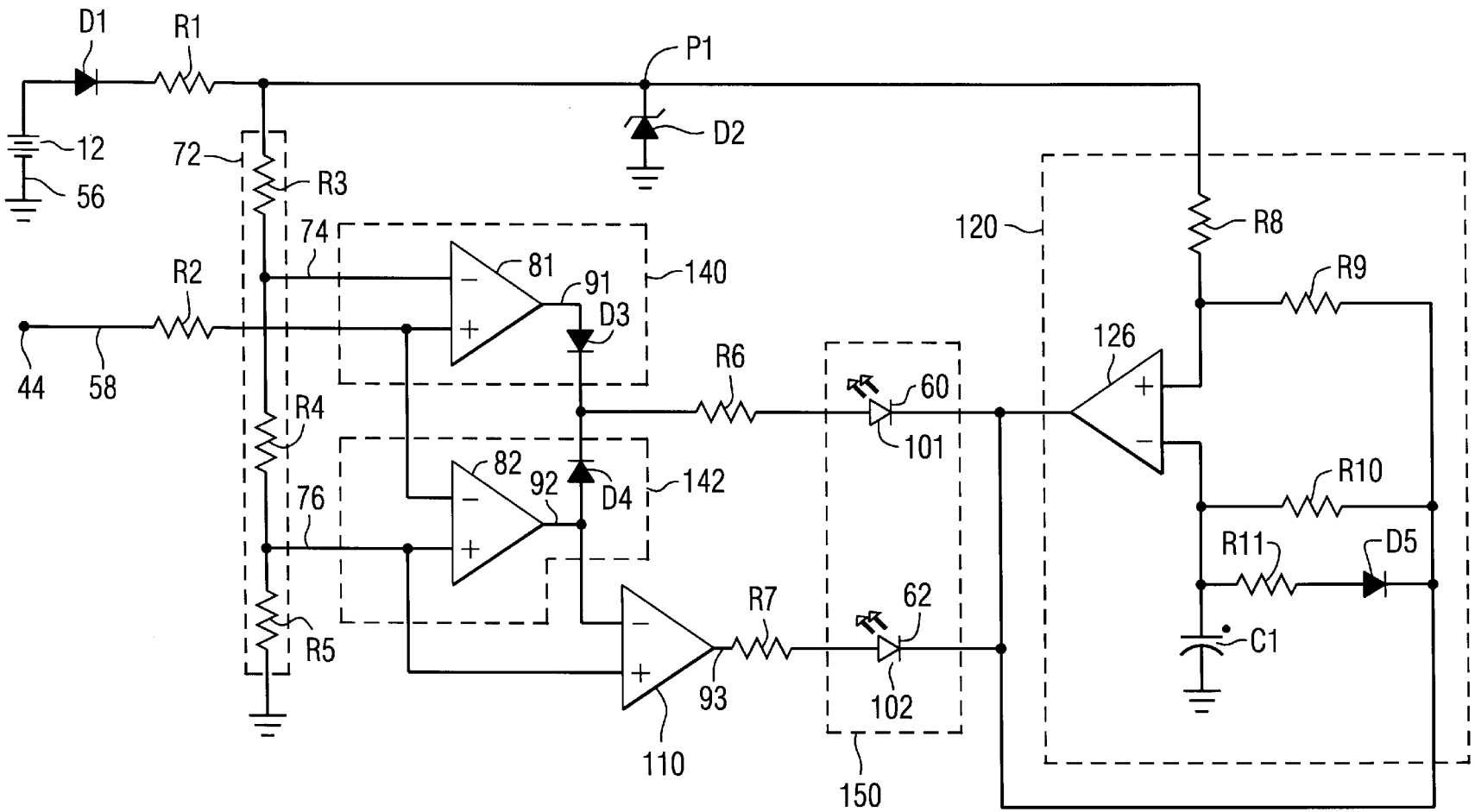
FIG. 4 is an electrical schematic of a circuit usable in conjunction with the present invention.

FIG. 4 is an electrical schematic of a circuit that is suitable for performing the function of the present invention. In the following description of FIG. 4, the component values and identification specified refer to one particularly preferred embodiment of the circuit and are not limiting to the present invention. As is well understood by those skilled in the art, the absolute magnitudes of the components and the particular types of components used in the circuit of FIG. 4 can be changed without adversely affecting the operation of the present invention as long as certain relationships and characteristics of the components are maintained.

FIG. 4 shows the battery 12 connected to a line 56 that is intended to be connected to the component to be protected from corrosion, such as the stern drive housing 34 described above in conjunction with FIGS. 2 and 3. The diode D1 restricts the direction of the current and resistor R1, which is 20 kΩ, operates as a current limiter to protect diode D2. Diode D2 is a Zenner diode identified by type number 1N5231. It is a 5.1 volt Zenner diode that maintains a voltage of 5.1 volts at point P1 in the circuit. Resistor R3 is 100 kΩ, resistor R4 is 7.5 kΩ, and resistor R5 is 20 kΩ. These three resistors form a bridge 72 which provides preselected voltage potentials on line 74 of 1.1 volts and on line 76 of 0.8 volts. These references are used as the first and second reference signals, respectively. The first reference signal on line 74 is connected to the inverting input of a first comparator 81. The second reference signal on line 76 is connected to the non-inverting input of a second comparator 82. As can be seen, the reference electrode 44 is connected by line 58 to the non inverting input of the first comparator 81 and to the inverting input of the second comparator 82. Resistor R2 is a current limiting resistor to protect the circuit in the event of a disconnection of any of the terminals. Resistor R2 is 100 kΩ. If the voltage potential of the reference electrode 44 is higher than the first reference signal on line 74, a first output signal is provided on line 91, through diode D3 and resistor R6, to a first annunciator 101. Resistor R6 is 510 Ω. Therefore, the first annunciator 101 is activated at any time when the voltage potential of the electrode 44 on line 58 is greater than the first reference voltage on line 74.

With continued reference to FIG. 4, the second comparator 82 compares the electrode voltage on line 58 to the second reference voltage on line 76. If the electrode 44 is at a voltage potential greater than the second reference signal on line 76, a low signal is provided on line 92 and this, through the operation of comparator 110, causes a high signal on line 93 to activate the second annunciator 102. Resistor R7 is 510 Ω.

If the voltage potential of the electrode 44 is too low, the second annunciator 102 is not activated. Also, if the voltage potential of the electrode 44 is too low, the first annunciator is activated by the output on line 92 through diode D4 and resistor R6.

In summary, the first and second annunciators, 101 and 102, operate in the following manner to inform the operator of the marine vessel the existing status of the galvanic protection system. If the voltage potential of the electrode 44, on line 58, is too low, the first annunciator 101 is energized and the second annunciator 102 is deenergized. If the voltage potential of the electrode 44, on line 58 is too high, both the first and second annunciators, 101 and 102, are energized. If the voltage potential of the electrode 44, on line 58, is proper and between the two reference signals on lines 74 and 76, the first annunciator 101 is deenergized and the second annunciator 102 is energized. Therefore, in essence, the first annunciator 101 is energized when the voltage potential of the electrode 44 is either too high or too low. The second annunciator 102 is energized when the voltage potential of the electrode 44 is greater than the minimum reference set at line 76, although possibly too high.

An oscillator circuit 120 provides a periodic deenergization of both the first and second annunciators, 101 and 102, to conserve electrical power provided by the battery 12. Resistor R8, which is 10 kΩ, and resistor R9, which is 100 kΩ, are used to set a reference voltage for the oscillator 120. Resistor R10, which is 1 MΩ, resistor R11, which is 100 kΩ, and capacitor C1 which is 6.8 μF combine with each other to set a duty cycle for the oscillator 120. The output from operational amplifier 126 deenergizes the first and second annunciators, 101 and 102, by preventing current flow through them. In a particularly preferred embodiment of the present invention, the duty cycle of the first and second annunciators, 101 and 102, is approximately 10%. These blinking lights inform the operator of a marine vessel of the status of the protection system.

In FIG. 4, reference numeral 72 identifies the bridge used to set the two reference signals on lines 74 and 76, reference numeral 140 identifies the first comparator circuit, reference numeral 142 identifies the second comparator circuit, and reference numeral 150 identifies the annunciators, 60 and 62.

In summary of the above description of FIG. 4, if the second annunciator 62 is energized and blinking while the first annunciator 60 is continually deenergized, the boat operator is informed of the fact that the galvanic protection system is operating properly. If both annunciators, 60 and 62 are energized, the system is overprotecting the component to be protected from corrosion and can therefore cause other types of damage to the system. If only the first annunciator 60 is energized, the component to be protected is being underprotected by the galvanic protection system.

Although the present invention is described as incorporating two individual annunciators, 60 and 62, as the first and second annunciators of the circuit, it should be understood that certain types of multi-colored annunciators are available for these purposes. For example, a tricolored LED is available from Industrial Devices, Inc. in commercial quantities. These components are identified as models 4361H1/5 and 5361H3/5. These single components provide red, green, and amber in a common three lead package. An annunciator of this type can be used in place of the first and second annunciators described above.

Although the present invention has been described with particular detail and illustrated to show one preferred embodiment of the present invention, it should be understood that alternative embodiments are also within its scope.

I claim:

1. A marine galvanic protection monitor, comprising:

an electrode disposed in noncontact association with a component to be protected from corrosion;

a first comparator connected in signal communication with said electrode and with a first reference signal, said first comparator providing a first output signal which is representative of the relative magnitudes of the voltage potentials of said electrode and said first reference signal;

a second comparator connected in signal communication with said electrode and with a second reference signal, said second comparator providing a second output signal which is representative of the relative magnitudes of the voltage potentials of said electrode and said second reference signal, said first and second comparators being connected in signal communication with said component to be protected from corrosion.

2. The monitor of claim 1, further comprising:

a marine propulsion unit, said marine propulsion unit being said component to be protected from corrosion.

3. The monitor of claim 2, wherein:

said marine propulsion unit is a stern drive unit.

4. The monitor of claim 1, further comprising:

a battery connected in electrical communication with said electrode, said first comparator, and said second comparator.

5. The monitor of claim 1, wherein:

said electrode is attached to a transom of a boat to which said component to be protected from corrosion is also attached.

6. The monitor of claim 1, further comprising:

a first annunciator connected in electrical communication with said first output signal and a second annunciator connected in electrical communication with said second output signal.

7. The monitor of claim 6, further comprising:

an oscillator connected in electrical communication with said first and second annunciators to periodically deactivate said first and second annunciators independently of the state of said first and second output signals.

8. A method for monitoring a marine galvanic protection system, comprising:

providing an electrode disposed in noncontact association with a component to be protected from corrosion;

comparing a voltage potential of said electrode with a first reference signal;

providing a first output signal which is representative of the relative magnitudes of the voltage potentials of said electrode and said first reference signal;

comparing a voltage potential of said electrode with a second reference signal;

providing a second output signal which is representative of the relative magnitudes of the voltage potentials of said electrode and said second reference signal.

9. The method of claim 8, further comprising:

causing said first output signal and said second output signal to both be high when said voltage potential of said electrode is higher than said first reference signal.

10. The method of claim 8, further comprising:

causing said second output signal to be high when said voltage potential of said electrode is higher than said second reference signal.

11. The method of claim 8, further comprising:

causing said first output signal to high when said voltage potential of said electrode is lower than said second reference signal.

12. A marine galvanic protection monitor, comprising:

means for providing an electrode disposed in noncontact association with a component to be protected from corrosion;

means for comparing a voltage potential of said electrode with a first reference signal;

means for providing a first output signal which is representative of the relative magnitudes of the voltage potentials of said electrode and said first reference signal;

means for comparing a voltage potential of said electrode with a second reference signal;

means for providing a second output signal which is representative of the relative magnitudes of the voltage potentials of said electrode and said second reference signal.

13. The monitor of claim 12, further comprising:

means for causing said first output signal and said second output signal to both be high when said voltage potential of said electrode is higher than said first reference signal.

14. The monitor of claim 13, further comprising:

means for causing said second output signal to be high when said voltage potential of said electrode is higher than said second reference signal.

15. The monitor of claim 14, further comprising:

means for causing said first output signal to high when said voltage potential of said electrode is lower than said second reference signal.

* * * * *